US008061124B2

(12) United States Patent
Miller et al.

(10) Patent No.: US 8,061,124 B2
(45) Date of Patent: Nov. 22, 2011

(54) DYNAMIC RICH TIME CAPABILITY FOR AFTERTREATMENT SYSTEMS

(75) Inventors: Paul R. Miller, Columbus, IN (US); Wei Lu, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 904 days.

(21) Appl. No.: 12/002,676

(22) Filed: Dec. 18, 2007

(65) Prior Publication Data

US 2008/0148709 A1 Jun. 26, 2008

Related U.S. Application Data

(60) Provisional application No. 60/876,086, filed on Dec. 20, 2006.

(51) Int. Cl.
*F01N 3/00* (2006.01)

(52) U.S. Cl. ..... 60/286; 60/285

(58) Field of Classification Search ..... 60/286
See application file for complete search history.

(56) References Cited

U.S. PATENT DOCUMENTS

| | | | | |
|---|---|---|---|---|
| 5,417,060 | A * | 5/1995 | Ishida et al. | 60/276 |
| 5,974,788 | A * | 11/1999 | Hepburn et al. | 60/274 |
| 6,477,832 | B1 | 11/2002 | Surnilla et al. | |
| 6,568,177 | B1 | 5/2003 | Surnilla | |
| 6,691,669 | B2 | 2/2004 | Surnilla | |
| 6,715,462 | B2 | 4/2004 | Bidner et al. | |
| 6,725,830 | B2 | 4/2004 | Surnilla | |
| 6,735,938 | B2 | 5/2004 | Surnilla | |
| 6,736,120 | B2 | 5/2004 | Surnilla | |
| 6,736,121 | B2 | 5/2004 | Gopichandra | |
| 6,745,747 | B2 | 6/2004 | Surnilla | |
| 6,758,185 | B2 | 7/2004 | Surnilla et al. | |
| 6,868,667 | B2 | 3/2005 | Surnilla | |
| 6,868,827 | B2 | 3/2005 | Surnilla | |
| 6,874,490 | B2 | 4/2005 | Surnilla | |
| 6,925,982 | B2 | 8/2005 | Surnilla et al. | |
| 6,951,098 | B2 | 10/2005 | Xu et al. | |
| 6,955,155 | B2 | 10/2005 | Surnilla | |
| 6,988,361 | B2 | 1/2006 | van Nieuwstadt et al. | |
| 7,032,572 | B2 | 4/2006 | Bidner et al. | |
| 7,047,932 | B2 | 5/2006 | Surnilla et al. | |
| 7,060,233 | B1 | 6/2006 | Srinivas et al. | |
| 7,069,910 | B2 | 7/2006 | Surnilla et al. | |
| 7,082,752 | B2 * | 8/2006 | Plote et al. | 60/277 |
| 7,111,450 | B2 | 9/2006 | Surnilla | |
| 7,121,080 | B2 | 10/2006 | Sun et al. | |
| 7,168,239 | B2 | 1/2007 | Ingram et al. | |
| 7,194,854 | B2 | 3/2007 | Surnilla et al. | |
| 2002/0189244 | A1 | 12/2002 | Surnilla et al. | |
| 2003/0089101 | A1 * | 5/2003 | Tanaka et al. | 60/285 |

(Continued)

FOREIGN PATENT DOCUMENTS

| | | |
|---|---|---|
| EP | 1 134 401 A2 | 9/2001 |

(Continued)

*Primary Examiner* — Thomas Denion
*Assistant Examiner* — Jason Shanske
(74) *Attorney, Agent, or Firm* — Matthew D. Fair; Krieg DeVault LLP

(57) ABSTRACT

One embodiment is a method including providing an exhaust aftertreatment system including an adsorber, commanding rich operation wherein the adsorber is provided with increased reductant, and ending rich operation upon the first of a commanded rich operation threshold being met or a confirmed rich operation threshold being met. Other embodiments include additional methods, software, apparatuses and systems. Further embodiments, forms, objects, features, advantages, aspects, and benefits shall become apparent from the following description and drawings.

25 Claims, 9 Drawing Sheets

U.S. PATENT DOCUMENTS

2003/0106306 A1* 6/2003 Nakatani et al. ..... 60/288
2003/0194366 A1 10/2003 Srinivas et al.
2003/0221416 A1 12/2003 Ingram et al.
2003/0221417 A1 12/2003 Surnilla
2003/0221418 A1 12/2003 Surnilla
2003/0221419 A1 12/2003 Surnilla
2003/0221655 A1 12/2003 Surnilla et al.
2003/0221659 A1 12/2003 Surnilla et al.
2003/0221660 A1 12/2003 Surnilla et al.
2003/0221664 A1 12/2003 Surnilla
2003/0221667 A1 12/2003 Surnilla
2003/0221671 A1 12/2003 Bidner et al.
2003/0221679 A1 12/2003 Surnilla
2003/0221681 A1 12/2003 Bidner et al.
2003/0221682 A1 12/2003 Surnilla
2003/0224907 A1 12/2003 Surnilla
2004/0083719 A1 5/2004 Xu et al.
2004/0173185 A1 9/2004 Surnilla et al.
2004/0182365 A1 9/2004 Surnilla
2004/0182374 A1 9/2004 Surnilla
2004/0206072 A1 10/2004 Surnilla et al.
2005/0076635 A1* 4/2005 Suyama et al. ..... 60/276
2005/0076887 A1 4/2005 Surnilla et al.
2005/0086933 A1 4/2005 Nieuwstadt et al.
2005/0252197 A1* 11/2005 Nieuwstadt et al. ..... 60/277
2006/0137327 A1* 6/2006 Shirakawa et al. ..... 60/285
2006/0154784 A1 7/2006 Surnilla et al.

FOREIGN PATENT DOCUMENTS

EP 1 698 766 A1 9/2006
EP 1 745 836 A1 1/2007
WO WO 03/082455 A2 10/2003

* cited by examiner

DYNAMIC RICH TIME CAPABILITY FOR AFTERTREATMENT SYSTEMS

PRIORITY

The benefits and rights of priority of U.S. Patent Application No. 60/876,086 filed Dec. 20, 2006 are claimed, and that application is incorporated by reference.

BACKGROUND

Internal combustion engines including diesel engines produce a number of combustion products including particulates, hydrocarbons ("HC"), carbon monoxide ("CO"), oxides of nitrogen ("NOx"), oxides of sulfur ("SOx"), and others. Diesel engines may be required to reduce or eliminate emission of these and other products of combustion, for example, by using one or more adsorbers to store SOx and/or NOx. When an adsorber reaches a certain storage capacity it can be regenerated. The regeneration of adsorbers to eliminate stored sulfurous or sulfur-containing compounds is termed deSOx. The regeneration of adsorbers to eliminate stored nitrogenous or nitrogen-containing compounds NOx is termed deNOx. DeNOx and deSOx may require control of a variety of different operating conditions.

SUMMARY

One embodiment is a method including providing an exhaust aftertreatment system including an adsorber, commanding rich operation wherein the adsorber is provided with increased reductant, and ending rich operation upon the first of a commanded rich operation threshold being met or a confirmed rich operation threshold being met. Other embodiments include additional methods, software, apparatuses, techniques, and systems. Further embodiments, forms, objects, features, advantages, aspects, and benefits shall become apparent from the following description and drawings.

DETAILED DESCRIPTION

Figure 1:
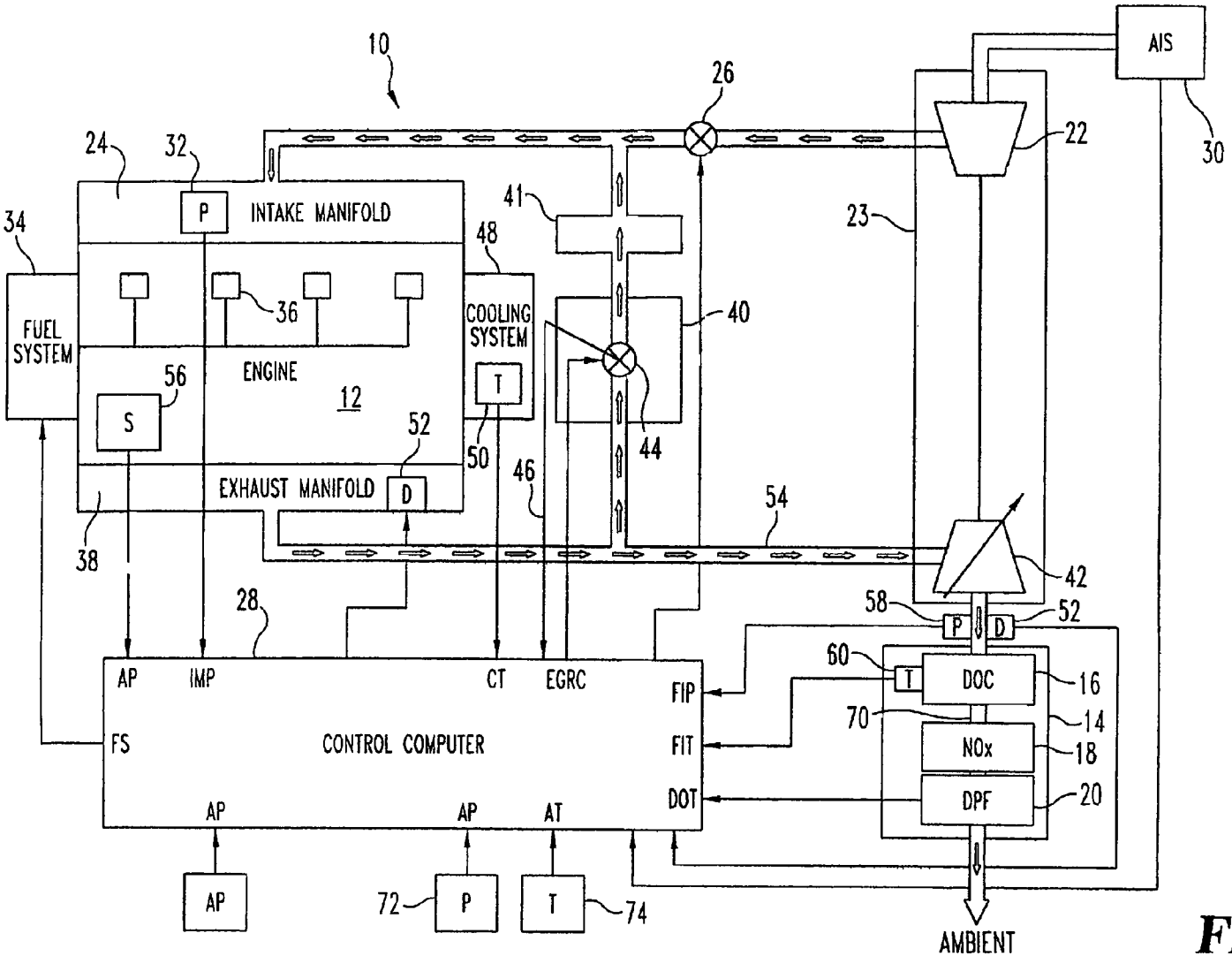
FIG. 1 is a schematic of an exemplary diesel engine system.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated embodiments, and such further applications of the principles of the embodiments illustrated therein being contemplated as would normally occur to one skilled in the art to which the invention relates.

With reference to FIG. 1, there is illustrated system 10 which includes an internal combustion engine 12 operatively coupled with an exhaust aftertreatment system 14. Exhaust aftertreatment system 14 includes a diesel oxidation catalyst unit 16 which is preferably a close coupled catalyst but could be other types of catalyst units, an adsorber, preferably a NOx adsorber, a lean NOx trap 18 or another type of adsorber, and a diesel particulate filter 20. The exhaust aftertreatment system 14 is operable to reduce or remove unwanted emissions from exhaust gas exiting the engine 12 after combustion.

Diesel oxidation catalyst unit 16 is preferably a flow through device that includes a canister that includes a honeycomb like structure or substrate. The substrate has a surface area that includes a catalyst. As exhaust gas from engine 12 traverses the catalyst, CO, gaseous HC and liquid HC (e.g., unburned fuel and oil) are oxidized and can be converted to carbon dioxide and water.

NOx adsorber 18 is operable to adsorb NOx and SOx emitted from engine 12 to reduce their emission into the atmosphere. NOx adsorber 18 includes catalyst sites which catalyzes oxidation reactions and storage sites which store compounds. After NOx adsorber 18 reaches a certain storage capacity it may be regenerated through deNOx and/or deSOx operations.

Diesel particulate filter 20 may include one or more of several types of particle filters. Diesel particulate filter 20 is utilized to capture unwanted diesel particulate matter from the flow of exhaust gas exiting the engine 12. Diesel particulate matter may include sub-micron size particles found in diesel exhaust, including both solid and liquid particles, as well as fractions such as inorganic carbon (soot), organic fraction (often referred to as SOF or VOF), and sulfate fraction (hydrated sulfuric acid). Diesel particulate filter 20 may be regenerated at regular intervals by combusting particulates collected in diesel particulate filter 20, for example, through exhaust manipulation.

During engine operation, ambient air is inducted from the atmosphere and is preferably compressed by a compressor 22 of a turbocharger 23 before being supplied to the engine 12. The compressed air is supplied to the engine 12 through an intake manifold 24 that is connected with the engine 12. An air intake throttle valve 26 may be positioned between the compressor 22 and the engine 12 that is operable to control the amount of charge air that reaches the engine 12 from the compressor 22. The air intake throttle valve 26 may be coupled with, and controlled by, an engine control unit ("ECU") 28, but may be controlled by other controllers as well. The air intake throttle valve 26 is operable to control the amount of charge air entering the intake manifold 24 via the compressor 22.

An air intake sensor 30 is included either before or after the compressor 22 to monitor the amount of ambient air or charge air being supplied to the intake manifold 24. The air intake sensor 30 may be connected with the ECU 28 and may generate electric signals indicative of the amount of charge air flow. An intake manifold pressure sensor 32 is connected with the intake manifold 24. The intake manifold pressure sensor 32 is operative to sense the amount of air pressure in the intake manifold 24, which is indicative of the amount of air flowing or provided to the engine 12. The intake manifold pressure sensor 32 is connected with the ECU 28 and generates electric signals indicative of the pressure value that are sent to the ECU 28.

The system 10 may also include a fuel injection system 34 such as a high pressure common rail fuel system that is connected with, and controlled by, the ECU 28. The purpose of the fuel injection system 30 is to deliver fuel into the cylinders of the engine 12, while precisely controlling the timing of the fuel injection, fuel atomization, the amount of fuel injected, the number and timing of injection pulses, as well as other parameters. In certain embodiments stratified injection modes may be used. In other embodiments homogeneous, partial homogeneous and/or mixed injection modes may be used. Fuel is injected into the cylinders of the engine 12 through one or more fuel injectors 36 and is combusted, preferably by compression, with charge air and/or EGR received from the intake manifold 24. Various types of fuel injection systems may be utilized in the present invention, including, but not limited to, pump-line-nozzle injection systems, unit injector and unit pump systems, common rail fuel injection systems and others.

Exhaust gases produced in each cylinder during combustion exit the engine 12 through an exhaust manifold 38 connected with the engine 12. A portion of the exhaust gas may be routed to an exhaust gas recirculation ("EGR") system 40 and a portion of the exhaust gas is supplied to a turbine 42. The turbocharger 23 may be a single variable geometry turbocharger 23, but other types and/or numbers of turbochargers may be utilized as well. The EGR system 34 may be used to cool down the combustion process by providing a selectable amount of exhaust gas to the charge air being supplied by the compressor 22. Cooling combustion may reduce the amount of NOx produced during combustion. One or more liquid, charge air, and/or other types of EGR coolers 41 may be included to further cool the exhaust gas before being supplied to the air intake manifold 22 in combination with the compressed air passing through the air intake throttle valve 26.

EGR system 40 includes an EGR valve 44 in fluid communication with the outlet of the exhaust manifold 38 and the air intake manifold 24. EGR valve 44 may also be connected to ECU 28, which is capable of selectively opening and closing EGR valve 44. EGR valve 44 may also have incorporated therewith a differential pressure sensor that is operable to sense a pressure change, or delta pressure, across EGR valve 44. A pressure signal 46 may also be sent to ECU 44 indicative of the change in pressure across EGR valve 44. An air intake throttle valve 26 and EGR system 40, in conjunction with fuel injection system 34, may be controlled to run engine 12 in a rich mode or in a lean mode.

The portion of the exhaust gas not communicated to the EGR system 40 is communicated to turbine 42 of a turbocharger, which is driven by gases flowing through the turbine 42. Turbine 42 is connected to compressor 22 and provides driving force for compressor 22 which generates charge air supplied to the air intake manifold 24. As exhaust gas leaves turbine 42, it is directed to exhaust aftertreatment system 14, where it is treated before exiting the system 10.

A cooling system 48 may be connected with the engine 12. The cooling system 48 transfers heat out of the block and other internal components of the engine 12. to a liquid coolant. The cooling system 48 preferably includes a water pump, radiator or heat exchanger, water jacket (including coolant passages in the block and heads), and a thermostat. Thermostat 50, which is the only component of cooling system 48 illustrated in FIG. 1, is connected with ECU 28. Thermostat 50 is preferably operable to generate a signal that is sent to ECU 28 that indicates the temperature of the coolant used to cool engine 12.

System 10 may include a doser 52 which may be located in the exhaust manifold 38 and/or located downstream of the exhaust manifold 38. Doser 52 may comprise an injector mounted in an exhaust conduit 54. In the illustrated embodiment, the reductant or reducing agent introduced through the doser 52 is diesel fuel; however, other embodiments are contemplated in which one or more different reductants are used in addition to or in lieu of diesel fuel. Additionally, reductant dosing could occur at a different location from that illustrated. Doser 52 is in fluid communication with a fuel line coupled to a source of fuel or other reductant (not shown) and is also connected with the ECU 28, which controls operation of the doser 52. Other embodiments omit or do not utilize a doser. For example, a preferred embodiment utilizes in-cylinder dosing where the timing and amount of fuel injected into the engine cylinders by fuel injectors is controlled in such a manner that engine 12 produces exhaust including a controlled amount of un-combusted (or incompletely combusted) fuel. Further embodiments may use a combination of in-cylinder dosing and dosing from a doser.

System 10 also includes a number of sensors and sensing systems for providing ECU 28 with information relating to system 10. An engine speed sensor 56 may be included in or associated with engine 12 and is connected with ECU 28. Engine speed sensor 56 is operable to produce an engine speed signal indicative of engine rotation speed ("RPM") that is provided to ECU 28. A pressure sensor 58 may be connected with the exhaust conduit 54 for measuring the pressure of the exhaust before it enters the exhaust aftertreatment system 14. Pressure sensor 58 may be connected with ECU 28. If pressure becomes too high, this may indicate that a problem exists with the exhaust aftertreatment system 14, which may be communicated to ECU 28.

At least one temperature sensor 60 may be connected with the diesel oxidation catalyst unit 16 for measuring the temperature of the exhaust gas as it enters the diesel oxidation catalyst unit 16. In other embodiments, two temperature sensors may be used, one at the entrance or upstream from the diesel oxidation catalyst unit 16 and another at the exit or downstream from the diesel oxidation catalyst unit 16 or at other locations. These temperature sensors are used to calculate the temperature of the diesel oxidation catalyst unit 16. In one embodiment, an average temperature may be determined, using an algorithm, from the two respective temperature readings of the temperature sensors 60 to arrive at an operating temperature of the diesel oxidation catalyst unit 16.

Figure 2:
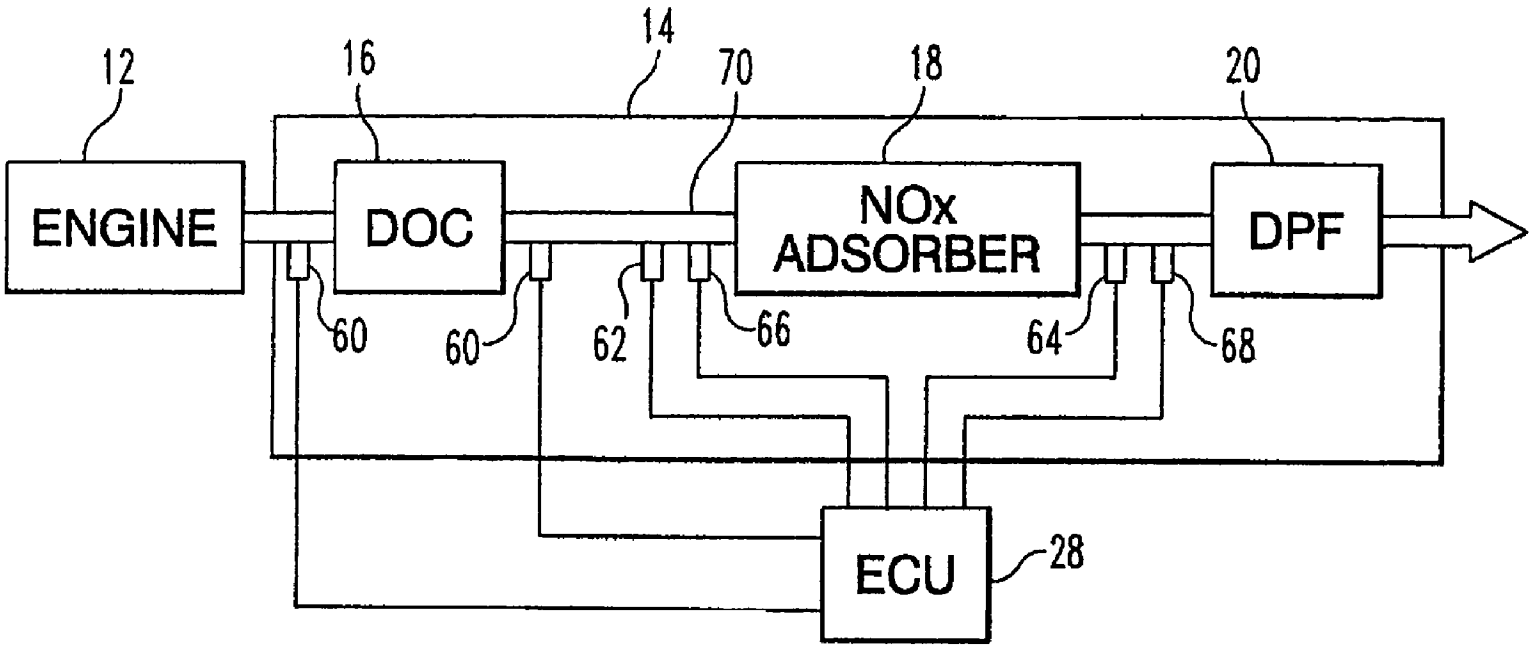
FIG. 2 is a schematic the exhaust aftertreatment system of the system of FIG. 1.

Referring to FIG. 2, a schematic diagram of exemplary exhaust aftertreatment system 14 is depicted connected in fluid communication with the flow of exhaust leaving the engine 12. A first NOx temperature sensor 62 may be in fluid communication with the flow of exhaust gas before entering or upstream of the NOx adsorber 18 and is connected to ECU 28. A second NOx temperature sensor 64 may be in fluid communication with the flow of exhaust gas exiting or downstream of the NOx adsorber 18 and is also connected to ECU 28. NOx temperature sensors 62, 64 are used to monitor the temperature of the flow of gas entering and exiting NOx adsorber 18 and provide electric signals to ECU 28 which are indicative of the temperature of the flow of exhaust gas. An algorithm may then be used by ECU 28 to determine the operating temperature of NOx adsorber 18.

A first universal exhaust gas oxygen ("UEGO") sensor or lambda sensor 66 may be positioned in fluid communication with the flow of exhaust gas entering or upstream from NOx adsorber 18 and a second UEGO sensor or lambda sensor 68 may be positioned in fluid communication with the flow of exhaust gas exiting or downstream of NOx adsorber 18. Sensors 66, 68 are connected with ECU 28 and generate electric signals that are indicative of the amount of oxygen contained in the flow of exhaust gas. Sensors 66, 68 allow ECU 28 to accurately monitor air-fuel ratios ("AFR") also over a wide range thereby allowing ECU 28 to determine a lambda value associated with the exhaust gas entering and exiting NOx adsorber 18.

Referring back to FIG. 1, an ambient pressure sensor 72 and an ambient temperature sensor 74 may be connected with ECU 28. Ambient pressure sensor 72 is utilized to obtain an atmospheric pressure reading that is provided to ECU 28. As elevation increases, there are fewer and fewer air molecules. Therefore, atmospheric pressure decreases with increasing altitude at a decreasing rate. Ambient temperature sensor 74 is utilized to provide ECU 28 with a reading indicative of the outside temperature or ambient temperature. As set forth in greater detail below, when engine 12 is operating outside of calibrated ambient conditions (i.e. —above or below sea level and at ambient temperatures outside of approximately 60-80° F.) the present invention may utilize a closed-loop control module to maintain the bed temperature of NOx adsorber 18 at the preferred regeneration temperature value (e.g. —650° C.).

Figure 3:
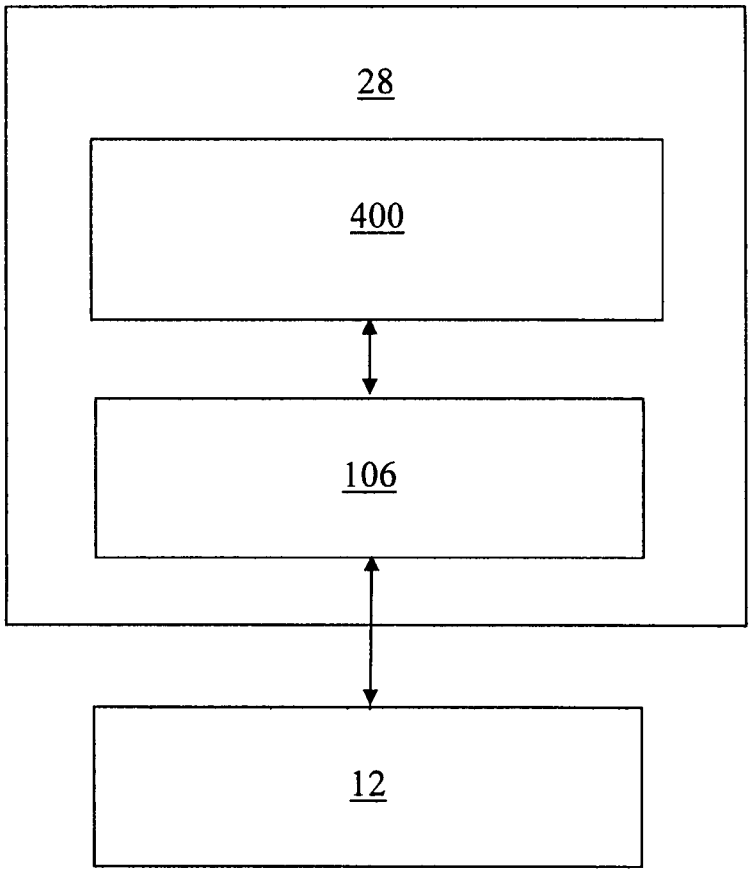
FIG. 3 is a diagram of an exemplary controls executable by an ECU or other processor.

With reference to FIG. 3, there is illustrated a diagram of a preferred deSOx control module 400 and a combustion manager module 106 which are preferably code stored in a computer accessible medium and executable by ECU 28. A module can include software, firmware, hardware, and combinations of these and other elements. De-SOx control module 400 can command and control regeneration of an adsorber such as NOx adsorber 18 to remove SOx that builds up on or is trapped by adsorber 18. De-SOx control module 400 can communicate with combustion manager module 106 and with engine 12 to control aspects of engine operation, for example, the number and/or timing of fuel injection pulses, and/or amount of fuel injected in a pulse. Furthermore, engine 12 could be coupled to drive a vehicle, generator or other systems.

Figure 4:
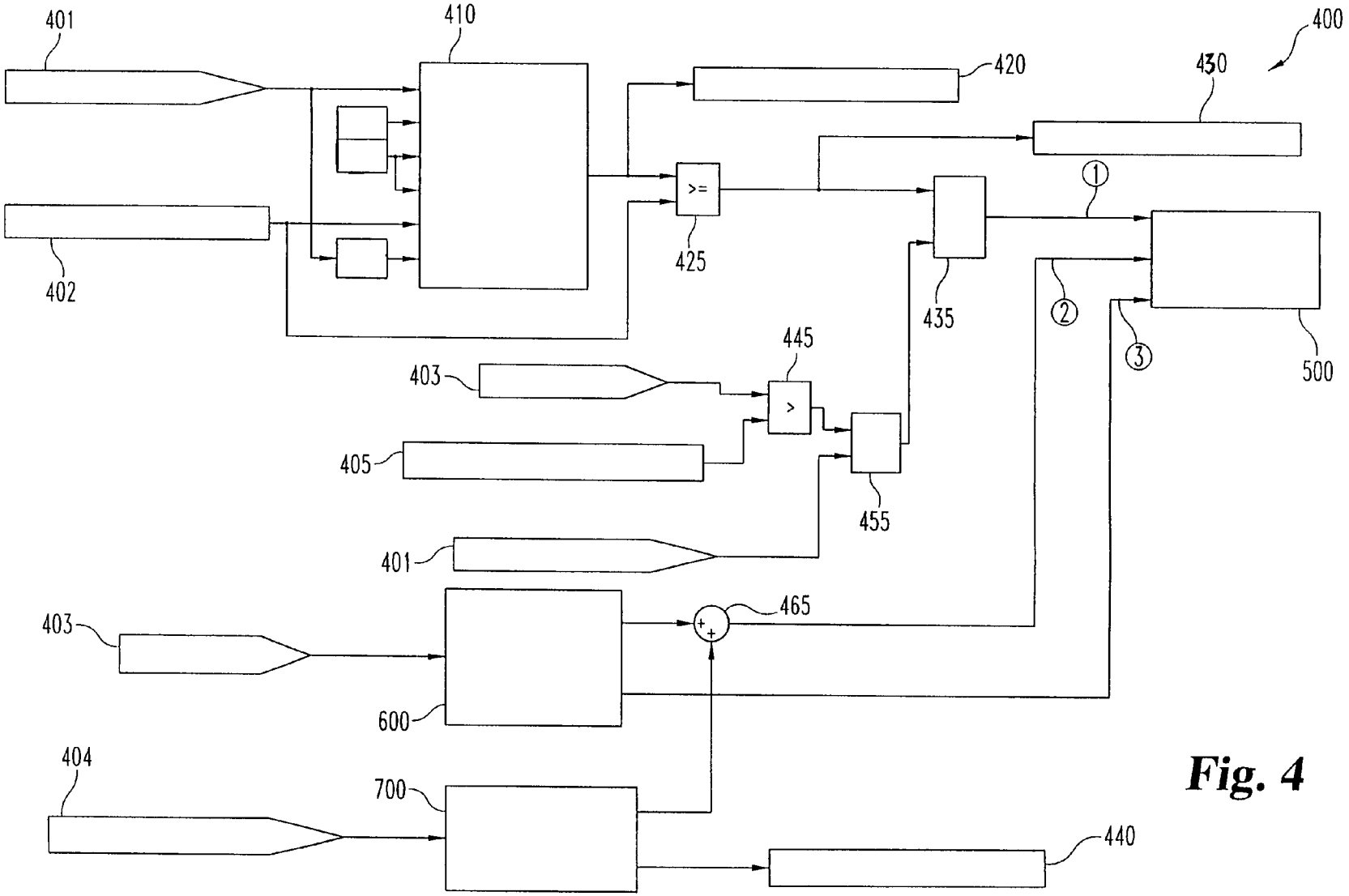
FIG. 4 is a diagram of an exemplary aftertreatment control system.

With reference to FIG. 4, there is illustrated a diagram of a preferred deSOx control module 400. In general, control module 400 controls the deSOx modes of operation for a diesel engine. In a lean operating mode, relatively little unburned or partially burned fuel (or another reductant) and relatively abundant oxygen are provided to a NOx adsorber, such as NOx adsorber 18, which operates to adsorb SOx and NOx. In rich or deSOx operating mode(s) an increased amount or relatively abundant amount of unburned or partially burned fuel (or another reductant) and relatively little oxygen are provided to a NOx adsorber which is regenerated. The preferred operation of deSOx control module 400 is further described as follows.

Variable 401, the deSOx enable variable, is input to the incr condition input of deSOx delay counter 410. When variable 401 is true, deSOx delay counter 410 will increment. When variable 401 is false, deSOx delay counter 410 will not increment. The logical inverse of variable 401 is received by the reset input of deSOx delay counter 410. When variable 401 is true, deSOx delay counter 410 will not reset. When variable 401 is false, deSOx delay counter 410 will reset. An increment value is input to the incr value input of deSOx delay counter 410 which is used to increment counter 410 by the increment value. Variable 402, the deSOx delay time variable, is input to the max limit input of deSOx delay counter 410 and sets the maximum limit to which deSOx delay counter 410 will increment. The output of deSOx delay counter 410 is provided to variable 420, the deSOx delay timer variable. Conditional 425 tests if variable 420 >= variable 402 and outputs the logical value of the test (true or false). The output of conditional 425 is provided to variable 430, the deSOx delay complete variable. Thus, variable 430 is true when a specified deSOx delay period has passed, and false if a specified deSOx delay period has not passed.

Variable 403, the NOx adsorber bed temperature variable, is a function of NOx adsorber catalyst/storage bed temperature. Variable 405 is a deSOx catalyst/storage bed temperature threshold variable. Conditional 445 tests if variable 403 > variable 405 and outputs the logical value of the test (true or false) which is then provided to conditional 445. Variable 401 is also provided to conditional 455 which is a Boolean AND operator. Thus, conditional 455 will output true when the NOx adsorber catalyst/storage bed temperature exceeds a threshold and deSOx is enabled. The output of conditional 455 is input to conditional 435 which is a Boolean OR operator to which variable 430 is also input. The output of conditional 435 is input to input 1 of deSOx beta timer 500.

Variable 403 is input to feedforward temperature control module 600 whose first output is provided to operator 465 and whose second output is provided to input 3 of deSOx beta timer 500. Variable 404, the deSOx target NOx adsorber catalyst/storage bed temperature is input to variable 700 whose first output is provided to operator 465 and whose second output is provided to variable 440. Variable 440 may be used to control timing and/or quantity of the auxiliary injection pulses (post main injection pulses) which are provided for various modes of injector operation. Operator 465 sums its inputs and provides its output to input 2 of deSOx beta timer 500.

Figure 4A:
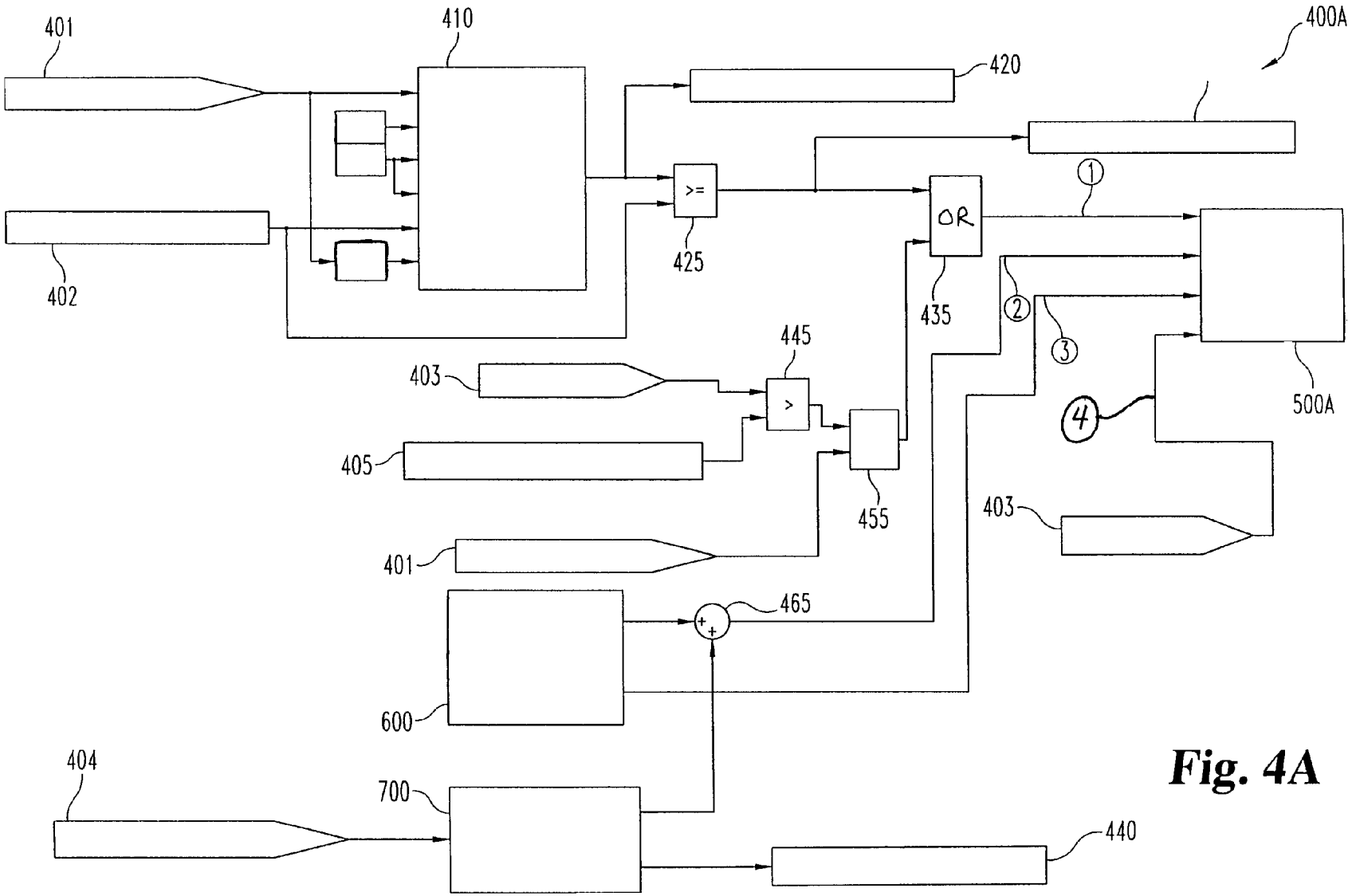
FIG. 4A is a diagram of an exemplary deSOx control module.

With reference to FIG. 4A, there is illustrated a diagram of deSOx control module 400A. In general, control module 400A is similar to control module 400 of FIG. 4, however, in module 400A variable 403 is provided to input 4 of deSOx beta timer 500A instead of to feedforward temp control 600 as in module 400.

Figure 5:
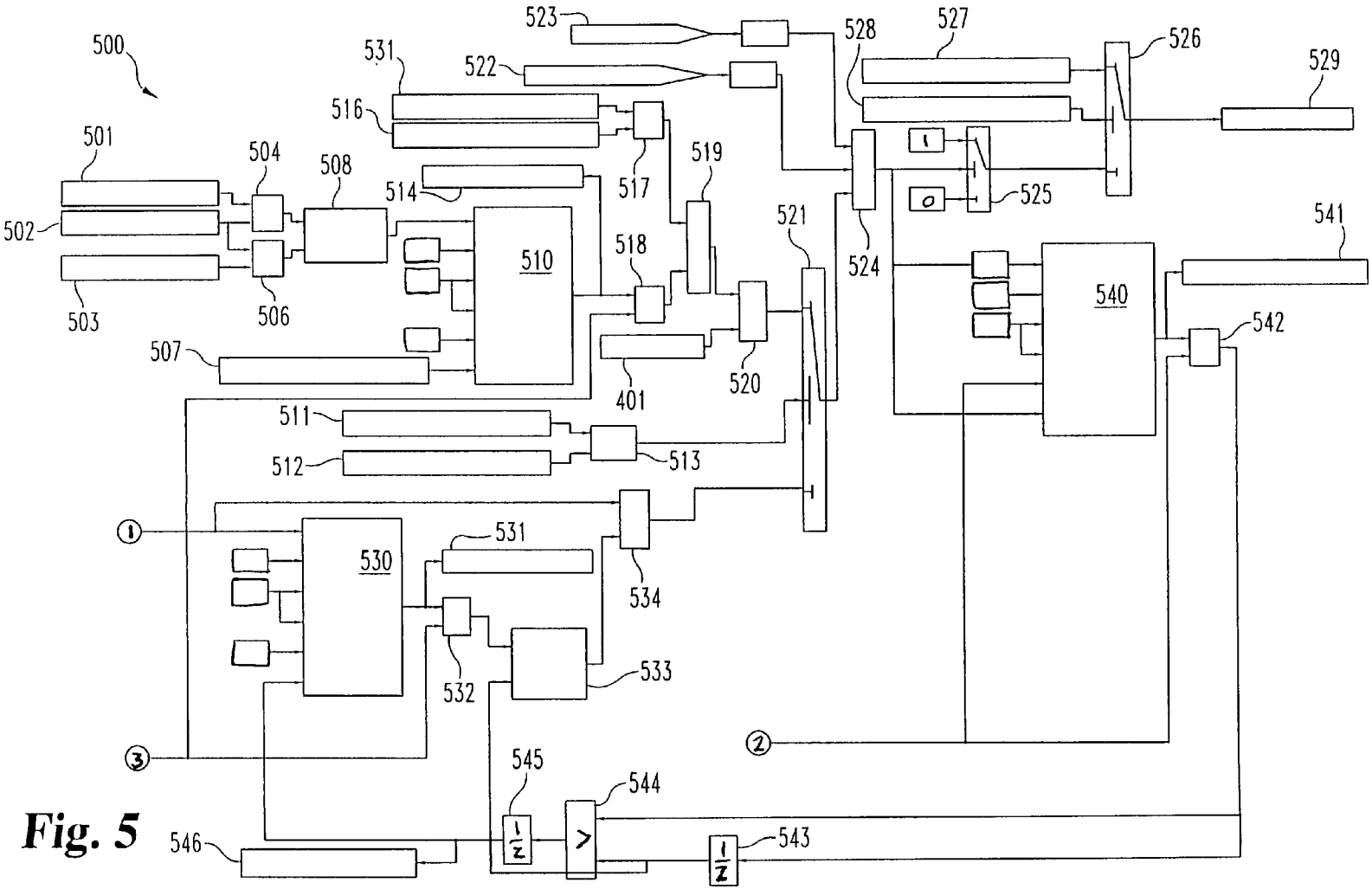
FIG. 5 is a diagram of deSOx beta timer 500 of FIG. 4.

With reference to FIG. 5, there is illustrated a diagram of deSOx beta timer 500 of FIG. 4. In general, deSOx beta timer 500 controls duration or termination of lean operation (also referred to as $\beta_0$) and rich operation (also referred to as $\beta_1$). The operation of deSOx beta timer 500 is further described as follows.

Variable 501 is a rich lambda threshold which defines lambda value at or below which rich operation is occurring. Variable 502 is a lambda value which is a function of the output of a sensor positioned between the outlet of a diesel oxidation catalyst and the input of a NOx adsorber, for example, UEGO or lambda sensor 66 which provides an indication of the air fuel ratio exiting the diesel. oxidation catalyst and entering the NOx adsorber. Conditional 504 tests if variable 501 >= variable 502 and outputs the logical result to the input node of latching logic 508. Thus, the input node of latching logic receives a true value when the sensed lambda value is at or below a threshold that indicates rich operation, and receives a false value otherwise.

Variable 503 is a lean lambda threshold which defines a value at or above which lean operation is occurring. Conditional 506 tests if variable 502 >= variable 503 and outputs the logical result of the evaluation to the reset node of latch logic 508. Thus, latching logic 508 will reset when the sensed lambda value is greater than or equal to a threshold defined for lean operation. Latching logic 508 outputs to the incr condition input of dynamic rich timer 510. If the incr condition input receives a true input dynamic rich timer 510 increments. If the incr condition input receives a false input dynamic rich timer 510 does not increment. Thus, dynamic rich timer 510 increments only when the output of the diesel oxidation catalyst or the input to the NOx adsorber is sensed as rich.

Dynamic rich timer 510 receives an increment value at its incr value input, a false value at its decr condition and decr value inputs since it operates to increment, not decrement, a reset variable 507 at its reset input, and an infinite, deactivate max, or large value at its max limit input. In other embodiments, dynamic rich timer 510 could be configured to decrement. Since the termination event is controlled by the timer value exceeding a defined value and can be reset by the value of variable 507 being true, it is not necessary to control the maximum count limit. In other embodiments, dynamic rich timer could be bounded by a maximum limit.

The output of dynamic rich timer 510 is provided to variable 514 and to an input of conditional 518. The RGM_DeSOx_Rich_Time variable which is output from feedforward temp control module 600 (illustrated in FIG. 4 and in greater detail in FIG. 6) is provided to the other input of conditional 518 which evaluates whether the output of dynamic rich counter 510 (or variable 514) < the RGM_DeSOx_Rich_Time variable. Thus, conditional 518 outputs false when the deSOx time limit has not been met or exceeded and true when the deSOx time limit has been met or exceeded. The output of conditional 518 is provided to conditional 519.

Variable 531, the RGM_DeSOx_Rich_Timer variable output from duty cycle rich timer 530, and variable 516, the C_RGM_SXM_Tmptr_Max_Rich_Time variable which is a limit for the commanded rich time, are provided to conditional 517 which evaluates whether variable 531 >=variable 516. When the commanded rich operation time has not reached or exceeded its threshold limit, the output of conditional 517 is true. When the commanded rich operation time has reached or exceeded its threshold limit, the output of conditional 517 is false.

The output of conditional 517 is provided to conditional 519. As stated above, the output of conditional 518 is also provided to conditional 519. Conditional 519 is a Boolean OR operator. The output of conditional 519 is true if either the commanded deSOx time has reached or exceeded its maximum threshold or the dynamic rich timer has reached or exceeded its threshold.

The output of conditional 519 and variable 401, the deSOx enable variable are provided to conditional 520 which is a Boolean AND operator. The output of conditional 520 is provided to the top input of switch 521. Variable 511, which indicates whether the deSOx dynamic rich time mode is active, and variable 512 which indicates whether oxygen sensor output is reliable or believable are provided to conditional 513 which is a Boolean AND operator. The output of conditional 513 is provided to the selection input of switch 521. When the output of conditional 513 is true, switch 521 is in the illustrated mode where it outputs the value at its top input. When the output of conditional 513 is false, switch 521 outputs the value at its bottom input.

The output of switch 521 is provided to conditional 524 which is a Boolean AND operator. The logical inverse of variable 522, the deSOx time extension variable, and the logical inverse of variable 523, the deSOx keep hot active variable, are also provided to conditional 524. The output of conditional 524 is provided to the control input of switch 525 and to the reset input of duty cycle lean timer 540, the inverse of the output of conditional 524 is provided to the incr condition input of duty cycle lean timer 540.

The output of switch 525 is provided to the lower input of switch 526. Variable 527, the deSOx beta timer override value variable, is provided to the top input of switch 526, and variable 528, the deSOx beta timer override variable, is provided to the control input of switch 526. The output of switch 526 is provided to variable 529, the deSOx beta variable, which is used to control the deSOx mode. When variable 529 is true, the mode of operation is rich operation (also referred to as $\beta_1$) and deSOx of the NOx adsorber occurs. When variable 529 is false, the mode of operation is lean operation (also referred to as $\beta_0$) SOx adsorbtion occurs in the NOx adsorber.

Duty cycle rich timer 530 receives variable RGM_DeSOx_Delay_Complete from input 1 to deSOx beta timer as illustrated in FIGS. 4 and 5. This variable is also provided to conditional 534. This variable indicates that the deSOx delay has been competed and that deSOx is commanded. Duty cycle rich timer 530 receives an increment value at its incr value input, a false value at its decr condition and decr value inputs since it operates to increment, variable 546 at its reset input, and an infinite, deactivate max, or large value at its max limit input. In other embodiments, duty cycle rich timer 530 could be configured to decrement. Since the termination event is controlled by the timer value exceeding a defined value and can be reset by variable 546 being true, it is not necessary to control the maximum count limit. In other embodiments, dynamic rich timer could be bounded by a maximum limit.

The output of duty cycle rich timer 530 is provided to variable 531 and to conditional 532 which tests whether variable 531 (or the output of duty cycle rich timer 530) < the deSOx rich time variable which is provided at input 3 to deSOx beta timer as illustrated in FIGS. 4 and 5. The output of conditional 532 is provided to latching logic 533 which outputs to conditional 534. Conditional 534 is a Boolean AND operator which also receives the deSOx delay complete variable from input 1 to deSOx beta timer as illustrated in FIGS. 4 and 5. The output of conditional 534 is provided to switch 521.

As stated above, the output of conditional 524 is provided to the reset input of duty cycle lean timer 540, and the inverse of the output of conditional 524 is provided to the incr condition input of duty cycle lean timer 540. The variable RGM_DeSOx_Lean_Time from input 2 to deSOx beta timer as illustrated in FIGS. 4 and 5 is provided to the max limit input of duty cycle lean timer 540. The output of duty cycle lean timer 540 is provided to variable 541 and conditional 542 which tests whether variable 541 (or the output of duty cycle lean timer 540) >= the deSOx lean time variable. The output of conditional 542 is provided to operators 543 and 544 which output to latching logic 533 and operator 454 respectively. Operator 454 outputs to variable 546.

Figure 5A:
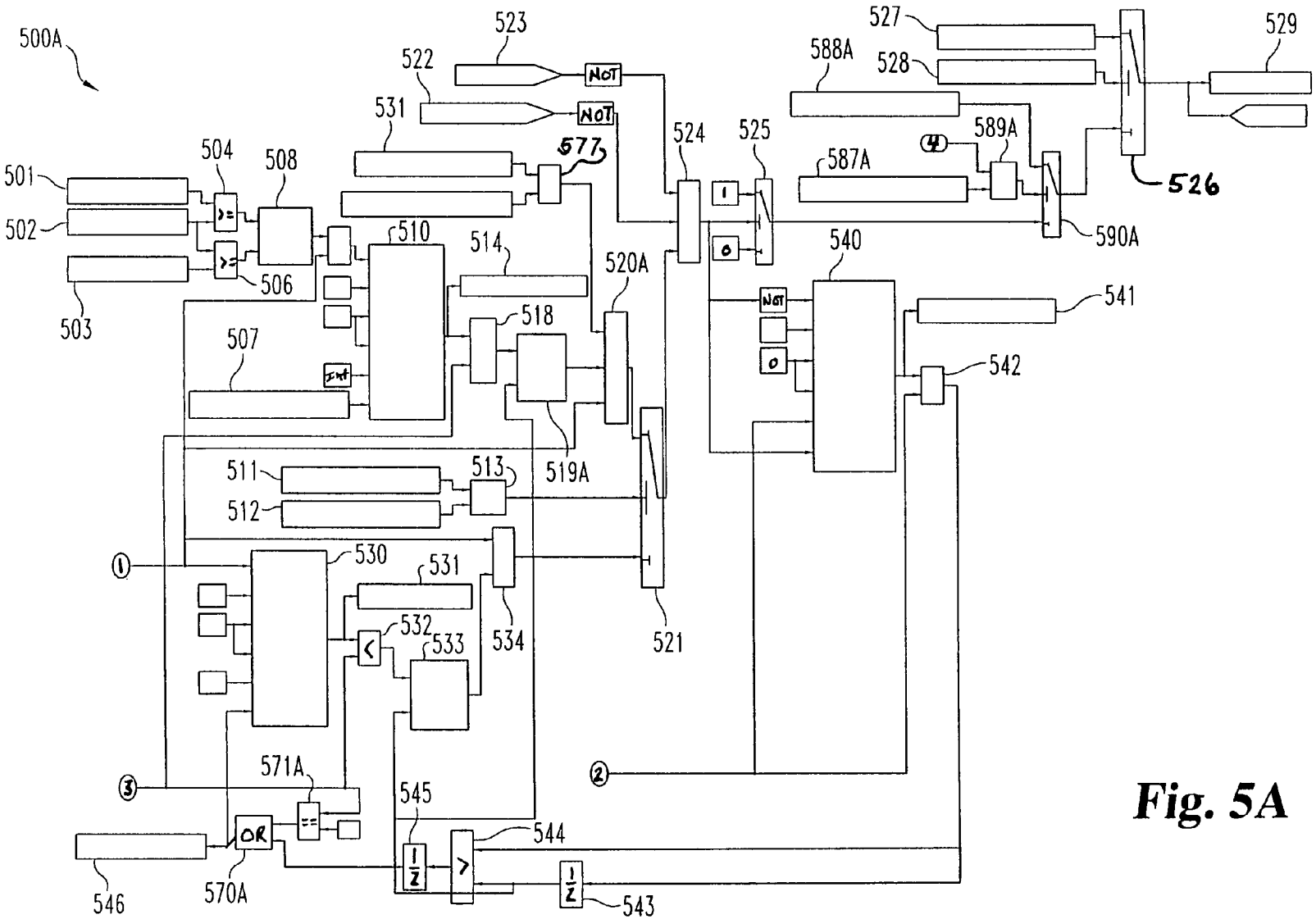
FIG. 5A is a diagram of deSOx beta timer 500A of FIG. 4A.

With reference to FIG. 5A, there is illustrated a diagram of deSOx beta timer 500A of FIG. 4A which includes many features discussed above in connection with timer 500. There are several differences between deSOx beta timer 500 and deSOx beta timer 500A. In deSOx beta timer 500A, the output of conditional 518 is provided to the input of latching logic 519A which outputs to conditional 520A. Conditional 520A is a Boolean AND operator that also receives the output of conditional 577, and the RGM_DeSOx_Rich_Time variable which is output from feedforward temp control module 600 illustrated in FIG. 4 and in greater detail in FIG. 6, and outputs to switch 521.

In deSOx beta timer 500A, the output of switch 525 is provided to the bottom input of switch 590A. Variable 588A, the deSOx over temperature beta variable, is provided to the top input of switch 590A. The NAC_Bed_Tmptr variable which indicates the temperature of the NOx adsorber bed and variable 587A, the deSOx beta switch max temperature variable, are provided to conditional 589A which tests whether variable NAC_Bed_Tmptr > variable 587.

In deSOx beta timer 500A conditional 570A receives the output of debounce 545. Conditional 570A is a Boolean OR operator which also receives the output of conditional 571A, and outputs to variable 546.

Figure 6:
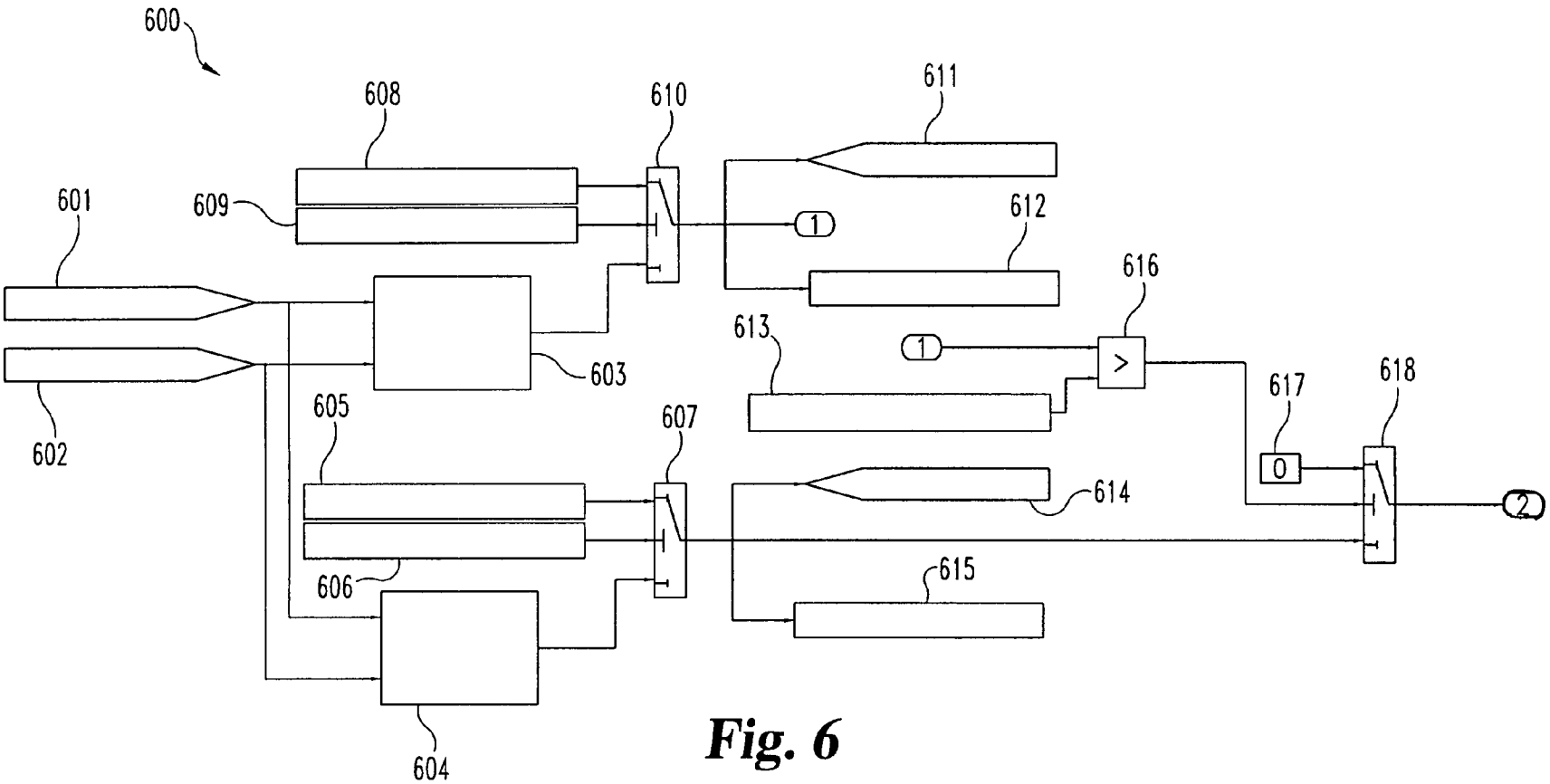
FIG. 6 is a diagram of feedforward temperature control 600 of FIG. 4.

With reference to FIG. 6, there is illustrated a diagram of feedforward temp control 600. Feedforward temp control 600 receives filtered engine speed 601 and final fueling variables 602 as inputs. These variables are provided to three dimensional lookup tables 603, 604 which provide their output to the illustrated switches 610 and variables. When the illustrated switches, variables and conditionals select the output of the tables, one table output is provided to the first output of feedforward temp control 600, and the other table output is provided to the second output of feedforward temp control 600.

Figure 7:
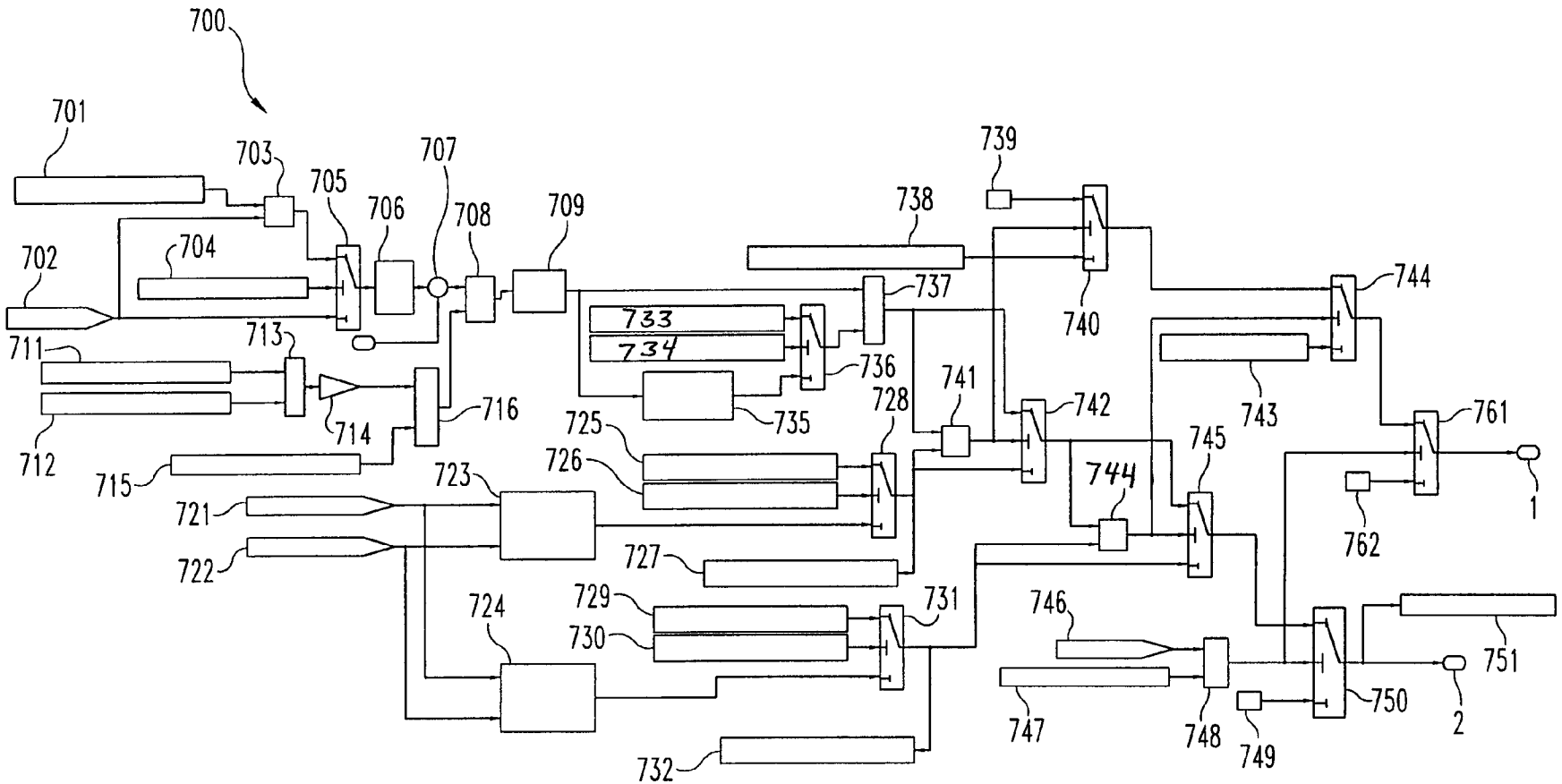
FIG. 7 is a diagram of feedback temperature control 700 of FIG. 4.

With reference to FIG. 7, there is illustrated a diagram of feedback temp control 700. Feedback temp control 700 receives filtered engine speed 721 and final fueling variables 722 as inputs. These variables are provided to three dimensional lookup tables 723, 724 which provide their output to the illustrated switches conditionals and variables. When the illustrated switches select the output of one table or the other, that table value is provided to second output of feedback temp control 700 which is the deSOx Aux SOI Adjust variable.

Feedback temp control 700 also receives the NAC_IN_Tmptr variable 701 which indicates the temperature of the input to the NOx adsorber, and the NAC_Bed_Tmptr variable 702 which indicates the temperature of the NOx adsorber bed and well as target temperature variables, an enable variable, and a factor variable. These variables are processed by the illustrated operators, switches, variables and table and provided to the first output of feedback temp control 700.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A method comprising:

providing an exhaust aftertreatment system including an adsorber;

commanding rich operation wherein the adsorber is provided with increased reductant;

activating a first timer based upon the commanding rich operation;

sensing a richness of flow to the adsorber;

activating a second timer based upon the richness meeting a criterion;

determining a commanded rich operation condition is satisfied in response to the first timer and determining a confirmed rich operation condition is satisfied in response to the second timer; and commanding an end of the rich operation based upon the first one of the commanded rich operation condition or the confirmed rich operation condition being satisfied.

2. A method according to claim 1 wherein the sensing a richness includes determining a lambda value based upon output from an oxygen sensor.

3. A method according to claim 1 wherein the first timer and the second timer are controlled by software to increment or decrement.

4. A method according to claim 1 further comprising passing information from a delay counter to a deSOx timer.

5. A method according to claim 1 further comprising passing information from a feedback temperature control module to a deSOx timer.

6. A method according to claim 1 further comprising passing information from a feed forward temperature control module to a deSOx timer.

7. A non-transitory computer readable medium storing instructions comprising:

a first conditional operable to evaluate a sensed richness from an oxygen sensor;

a counter operable to count based upon the first conditional;

a second conditional operable to evaluate an output of the counter;

an instruction to initiate a deSOx mode of operation; and an instruction to end the deSOx mode of operation based upon evaluation result of one of the first conditional and the second conditional.

8. A non-transitory computer readable medium according to claim 7 further comprising:

a second counter operable to count based upon a command for deSOx; and a third conditional operable to evaluate an output of the second counter.

9. A non-transitory computer readable medium according to claim 8 further comprising switch means for switching a termination criterion of the deSOx mode of operation between being based upon the second conditional and being based upon the third conditional.

10. A non-transitory computer readable medium according to claim 9 further comprising a means for timing a lean mode of operation.

11. A non-transitory computer readable medium according to claim 10 further comprising the ending of the deSOx mode of operation being bounded by a maximum threshold.

12. A non-transitory computer readable medium according to claim 7, wherein the oxygen sensor is positioned downstream of an oxygen storing device.

13. A non-transitory computer readable medium according to claim 7 further comprising instructions for in-cylinder dosing.

14. A non-transitory computer readable medium according to claim 13 wherein the instructions include commands for pre-injection, main injection, and post injection.

15. A non-transitory computer readable medium according to claim 14 wherein the instructions include commands for lean operation and rich operation.

16. A non-transitory computer readable medium according to claim 7 further comprising instructions for controlling homogeneous injection.

17. A non-transitory computer readable medium according to claim 7 wherein the counter is a timer.

18. A system comprising:

an emissions aftertreatment subsystem including a NOx adsorber;

an engine configured to exhaust to said emissions aftertreatment subsystem;

an oxygen sensor configured to provide a lambda value in the emissions aftertreatment subsystem; and a controller operable to control a deSOx of the NOx adsorber;

wherein the controller is operable to determine a time from confirmed rich operation in response to the lambda value; and wherein the controller is operable to control duration of deSOx based upon at least two timing events, wherein the two timing events include a time from commanded rich operation and the time from confirmed rich operation.

19. A system according to claim 18 wherein the oxygen sensor is further configured to provide the lambda value from one of a position upstream of the NOx adsorber and a position downstream of the NOx adsorber.

20. A system according to claim 18 wherein the controller is further operable to limit the maximum duration of a lean operation.

21. A system according to claim 18 wherein the oxygen sensor is further configured to provide the lambda value from a position upstream of the NOx adsorber.

22. A system according to claim 18 wherein the emissions aftertreatment subsystem includes means for aftertreating particulate, means for aftertreating NOx and/or SOx, and means for aftertreating hydrocarbon coupled in flow series.

23. A system according to claim 18 wherein the deSOx of the NOx adsorber comprises a rich mode of operation including in-cylinder dosing.

24. A system according to claim 18 wherein the deSOx of the NOx adsorber comprises a rich mode of operation consisting of in-cylinder dosing.

25. A system according to claim 18 wherein the oxygen sensor is further configured to provide the lambda value from a position downstream of the NOx adsorber.

* * * * *